US007967600B2

(12) United States Patent
Hong et al.

(10) Patent No.: US 7,967,600 B2
(45) Date of Patent: Jun. 28, 2011

(54) FLARE APPARATUS

(75) Inventors: Jianhui Hong, Broken Arrow, OK (US); James Wilkins, Fleet (GB); Jeff William White, Glenpool, OK (US); Roger L. Poe, Beggs, OK (US)

(73) Assignee: John Zink Company, LLC, Tulsa, OK (US)

( * ) Notice: Subject to any disclaimer, the term of this patent is extended or adjusted under 35 U.S.C. 154(b) by 44 days.

(21) Appl. No.: 11/390,953

(22) Filed: Mar. 27, 2006

(65) Prior Publication Data

US 2007/0224564 A1 Sep. 27, 2007

(51) Int. Cl.
*F23G 7/08* (2006.01)
*F23D 14/62* (2006.01)

(52) U.S. Cl. ..... 431/202; 431/354

(58) Field of Classification Search ..... 431/202, 431/190, 5, 354, 252, 355, 168; 110/210, 110/211, 212–214, 147, 150, 161; 432/72
See application file for complete search history.

(56) References Cited

U.S. PATENT DOCUMENTS

| | | | | |
|---|---|---|---|---|
| 2,506,972 | A * | 5/1950 | Schellentrager et al. | 431/202 |
| 3,273,627 | A * | 9/1966 | Zink | 431/202 |
| 3,512,911 | A * | 5/1970 | Reed et al. | 431/202 |
| 3,547,567 | A | 12/1970 | Turpin | |
| 3,703,349 | A | 11/1972 | Straitz, III | |
| 3,749,546 | A | 7/1973 | Reed et al. | |
| 3,797,991 | A | 3/1974 | Straitz, III | |
| 3,814,567 | A | 6/1974 | Zink et al. | |
| 3,817,695 | A | 6/1974 | Reed et al. | |
| 3,822,983 | A | 7/1974 | Proctor et al. | |
| 3,954,385 | A | 5/1976 | Reed et al. | |
| 3,982,881 | A | 9/1976 | Schwartz et al. | |
| 3,994,663 | A | 11/1976 | Reed | |
| 3,995,986 | A | 12/1976 | Straitz, III | |
| 4,035,171 | A | 7/1977 | Reed et al. | |
| 4,036,580 | A | 7/1977 | Reed et al. | |
| 4,039,276 | A | 8/1977 | Reed et al. | |
| 4,065,248 | A | 12/1977 | Straitz, III et al. | |
| 4,084,935 | A * | 4/1978 | Reed et al. | 431/202 |

(Continued)

FOREIGN PATENT DOCUMENTS

CA 2 236 224 A1 10/1999

(Continued)

OTHER PUBLICATIONS

T. W. Lee, M. Fenton and R. Shankland, "Effects of Variable Partial Premixing on Turbulent Jet Flame Structure," Combustion and Flame 109: 536-548 (1997), published by Elsevier Science, Inc.

(Continued)

*Primary Examiner* — Kenneth B Rinehart
*Assistant Examiner* — Chuka C Ndubizu
(74) *Attorney, Agent, or Firm* — McAfee & Taft

(57) ABSTRACT

A flare apparatus for burning combustible gases. A flare tip unit comprises an inner member and an outer member defining an annulus therebetween. The annulus defines an annular gas passage through which combustible gas passes. Air moved by a motive force, preferably steam, passes through the inner member and a steam/air mixture exits an outlet of the inner member. The combustible gas and an air/steam mixture mixes in a premix zone between the inner member outlet and the exit opening of the outer member. The combustible gas/air/steam mixture is ignited for burning in the atmosphere above the exit opening. The flare apparatus may include a plurality of flare tip units.

43 Claims, 6 Drawing Sheets

U.S. PATENT DOCUMENTS

| | | | | |
|---|---|---|---|---|
| 4,098,566 | A | | 7/1978 | Zink et al. |
| 4,105,394 | A | | 8/1978 | Reed et al. |
| 4,118,173 | A | | 10/1978 | Shakiba |
| 4,128,389 | A | | 12/1978 | Straitz, III |
| 4,140,471 | A | | 2/1979 | Straitz, III et al. |
| 4,154,570 | A | | 5/1979 | Schwartz |
| 4,157,239 | A | | 6/1979 | Reed |
| 4,188,183 | A | | 2/1980 | Zink et al. |
| 4,227,872 | A | | 10/1980 | Zink et al. |
| 4,229,157 | A | | 10/1980 | Ito et al. |
| 4,265,611 | A | | 5/1981 | Reed et al. |
| 4,336,017 | A | | 6/1982 | Desty |
| 4,419,071 | A | | 12/1983 | Schwartz |
| 4,457,696 | A | | 7/1984 | Schwartz et al. |
| 4,486,168 | A | | 12/1984 | Pratley |
| 4,492,558 | A | | 1/1985 | Schwartz et al. |
| 4,493,638 | A | | 1/1985 | Scammell |
| 4,516,932 | A | | 5/1985 | Chaudot |
| 4,565,522 | A | | 1/1986 | Schwartz |
| 4,573,906 | A | | 3/1986 | Schwartz et al. |
| 4,579,521 | A | | 4/1986 | Schwartz et al. |
| 4,604,047 | A | | 8/1986 | Coulthard |
| 4,637,793 | A | | 1/1987 | Schwartz et al. |
| 4,652,232 | A | | 3/1987 | Schwartz et al. |
| 4,652,233 | A | | 3/1987 | Hamazaki et al. |
| 4,824,361 | A | | 4/1989 | McGill et al. |
| 4,952,137 | A | | 8/1990 | Schwartz et al. |
| 5,275,115 | A | * | 1/1994 | Houston ..... 110/211 |
| 5,649,820 | A | | 7/1997 | Keller et al. |
| 5,681,160 | A | | 10/1997 | Ellis et al. |
| 5,810,575 | A | | 9/1998 | Schwartz et al. |
| 5,846,068 | A | | 12/1998 | Schwartz et al. |
| 5,865,613 | A | | 2/1999 | Rajewski |
| 6,012,917 | A | | 1/2000 | Wiseman |
| 6,146,131 | A | | 11/2000 | Wiseman |
| 6,485,292 | B1 | | 11/2002 | Rhodes et al. |
| 6,638,059 | B1 | * | 10/2003 | Mougey ..... 431/202 |
| 6,702,572 | B2 | | 3/2004 | Hong et al. |
| 6,840,760 | B1 | | 1/2005 | Keller et al. |
| 6,840,761 | B2 | | 1/2005 | Hong et al. |
| 7,156,193 | B2 | | 1/2007 | Swartout |
| 7,247,016 | B2 | | 7/2007 | Mashhour |
| 7,354,265 | B2 | * | 4/2008 | Mashhour et al. ..... 431/202 |
| 2002/0045140 | A1 | | 4/2002 | Payne et al. |
| 2005/0269135 | A1 | | 12/2005 | Swartout |
| 2006/0105276 | A1 | | 5/2006 | Wilkins et al. |
| 2007/0231758 | A1 | | 10/2007 | Harless |

FOREIGN PATENT DOCUMENTS

| | | | | |
|---|---|---|---|---|
| DE | 198 41 437 | A1 | | 4/1999 |
| EP | 0069486 | B1 | | 1/1983 |
| EP | 0 374 423 | A2 | | 6/1990 |
| EP | 0 057 518 | A2 | | 8/1992 |
| EP | 0694736 | A2 | | 1/1996 |
| GB | 1 393 224 | | | 5/1975 |
| GB | 2 001 424 | A | | 1/1979 |
| GB | 2 007 830 | A | | 5/1979 |
| GB | 1604441 | | | 12/1981 |
| GB | 2081872 | A | * | 2/1982 |
| GB | 2136557 | A | | 9/1984 |
| GB | 2292452 | A | | 2/1996 |
| GB | 2304180 | A | | 3/1997 |
| JP | 2000018550 | A | * | 1/2000 |
| JP | 2000 018550 | A | | 6/2000 |
| KR | 20-0337266 | | | 3/2004 |
| WO | WO 02086386 | A1 | | 10/2002 |
| WO | WO 2006060687 | A2 | | 6/2006 |
| WO | WO 2006060687 | A3 | | 6/2006 |

OTHER PUBLICATIONS

B. M. Cetegen and S. Basu, Soot Topography in a Planar Diffusion Flame Wrapped by a Line Vortex, Combustion and Flame 146, 2006, pp. 687-697, Elsevier Science, Inc.

Robert Schwartz, Jeff White and Wes Bussman, "Flares," The John Zink Combustion Handbook, 2001, pp. 589-634, CRC Press LLC, Boca Raton, Florida.

JZ and Kaldair—The World's Most Advanced Flares, John Zink Company, LLC, at http://johnzink.com/products/flares/html/flar_prod.htm, printed Mar. 24, 2009, John Zink Company, LLC, Tulsa, Oklahoma.

Air-Assisted Flares, John Zink Company, LLC, at http://johnzink.com/products/flares/html/flar_prod_aaf.htm, John Zink Company, LLC, Tulsa, Oklahoma.

John Zink Company Azdair PLA-28, Assisted Air Flare System, p. 1 of 1, John Zink Company, LLC, Tulsa, Oklahoma.

First Office Action and translation thereof dated Feb. 12, 2010, in corresponding Chinese Patent Application 200710088432.2 filed Mar. 27, 2007.

First Office Action dated Mar. 26, 2010, in corresponding Canadian Patent Application 2,582,103 filed Mar. 13, 2007.

Search Report and Examination Report dated Jun. 17, 2010, in corresponding European Patent Application 07251175.1.

Translation of "Notice of Reasons for Rejection" dated Oct. 1, 2010, of Office Action dated Aug. 31, 2010, in corresponding Japanese Patent Application No. 2007-079094.

Office Action of the IPO and translation thereof issued Aug. 16, 2010, in corresponding Taiwan Patent Application 096110181.

* cited by examiner

FLARE APPARATUS

BACKGROUND OF THE INVENTION

The present invention relates to an improved flare apparatus and more specifically to an efficient steam-assisted flare apparatus.

Flare apparatus for burning and disposing of combustible gases are well known. Flare apparatus are commonly mounted on flare stacks and are located at production, refining, processing plants and the like for disposing of flammable waste gases or other flammable gas streams which are diverted for any reason including but not limited to venting, shut-downs, upsets and/or emergencies. Flare apparatus are extremely important in the event of plant emergencies such as fire or power failure and a properly operating flare system is a critical component to prevent plant disruption in any of the above-mentioned or other circumstances.

It is generally desirable that the flammable gas be burned without producing smoke and typically such smokeless or substantially smokeless burning is mandatory. One method for accomplishing smokeless burning is by supplying combustion air with a steam jet pump, which is sometimes referred to as an eductor. Combustion air insures the flammable gas is fully oxidized to prevent the production of smoke. Thus, steam is commonly used as a motive force to move air in a flare apparatus. When a sufficient amount of combustion air is supplied, and the supplied air mixes well with combustible gas, the steam/air mixture and flammable gas can be smokelessly burned. In a typical flare apparatus, only a fraction of the required combustion air is supplied using motive force such as blower, a jet pump using steam, compressed air or other gas. Most of the required combustion air is obtained from the ambient atmosphere along the length of the flame.

One type of known steam-assisted flare apparatus comprises a generally cylindrical gas tube into which flammable gas is communicated. Lower steam is communicated through a plurality of steam tubes at an inlet and is forced to negotiate a bend in the steam tube, which causes a pressure drop. At the bend, the steam tubes are redirected so that they are parallel with the outer cylinder. Center steam is injected into the center of the gas tube so that flammable gas and steam pass upwardly through the outer tube and is mixed with steam that exits the lower steam tubes. At the upper end or exit of the gas tube, steam injectors direct steam radially inwardly to control the periphery of the mixture exiting the gas tube, and the steam/air and gas mixture is ignited. The center steam is provided to ensure burning does not occur internally in the gas tube. Internal burning is typically seen at low gas flow rates such as purge rates, and is aggravated by cross wind, capping effects caused by the upper steam, and if the purge gas has a lower molecular weight than air. A purge rate is typically the minimum gas flow rate continuously flowing to the flare to prevent explosion in the flare stack.

Another type of steam-assisted flare uses only center and upper steam injectors, and works in a similar fashion. The steam-assisted flares described herein may accomplish smokeless flaring. However, such flare apparatus may create an excessive amount of noise. The noise from the lower steam can be muffled, while the noise from the upper steam is difficult or impractical to muffle due to its vicinity to the flare flame. A muffler for the lower steam not only adds to the costs, but also increases the wind load of the flare stack, resulting in increased flare stack costs. Due to the high cost of steam and the piping and flare stack structure associated with delivering the steam, it is desirable that less steam be utilized to achieve smokeless burning. Thus, there is a need for an improved flare apparatus and methods for smokelessly burning combustible gases with air to lessen the noise and to increase the efficiency whereby more fuel may be burned with less added steam.

SUMMARY OF THE INVENTION

A flare apparatus in accordance with the current invention includes a plurality of flare tip units. Each flare tip unit has an outer member with first and second ends and an inner member defining an inlet and an outlet. At least a portion of the inner member is disposed and preferably is coaxially or concentrically disposed in the outer member. An annular gas passage is defined between the inner and outer member of each flare tip unit. An upper end of the outer member defines an exit opening while an upper end of the inner member defines the inner member outlet. Air passes through the inner member and exits the inner member outlet into the outer member.

Combustible gas passes through the annular gas passage and will exit the annular gas passage into the outer member above the inner member outlet where the combustible gas mixes with at least air in the outer member. The space between the inner member outlet and the exit opening may be referred as a premix zone, since gas and at least air mix therein prior to exiting through the exit opening for burning in the atmosphere.

While mechanical devices such as fans or blowers may be utilized to move air through the inner member, preferably steam is utilized as the motive force for the air. Likewise, compressed air, nitrogen, carbon dioxide, fuel gas or other gases can be used as a motive force similar to the manner steam is used. In a preferred embodiment of the current invention, steam is injected into an inlet of the inner member at a rate sufficient to draw air into the inner member so that a steam and air mixture passes through the inner member outlet into the premix zone. Preferably, the length of the premix zone is greater than the width of the annular gas passage and preferably is at least four times the width of the annular gas passage. The premix zone provides a space for the gas to mix with the air and steam and likewise comprises a perimeter control.

In a preferred embodiment, the flare apparatus of the current invention comprises a plurality of flare tip units, wherein the annular gas passage in each of the plurality of flare tip units receives gas from a single combustible gas supply. The single combustible gas supply may be for example a plenum to which each flare tip unit is connected. The combustible gas may be communicated from the plenum into the annular gas passage of each flare tip unit and a combustible gas and air/steam mixture will pass through the exit opening of each of the flare tip units in to the atmosphere. Each flare tip unit in the plurality of units will preferably have a steam injector associated therewith for providing the motive force for the air through the inner member of the flare tip unit. Steam is preferably provided to each of the steam injectors from a single source. The combustible gas may be communicated to the plenum through a gas pipe that will be connected in a flare stack.

BRIEF DESCRIPTION OF THE PREFERRED EMBODIMENT

Figure 1:
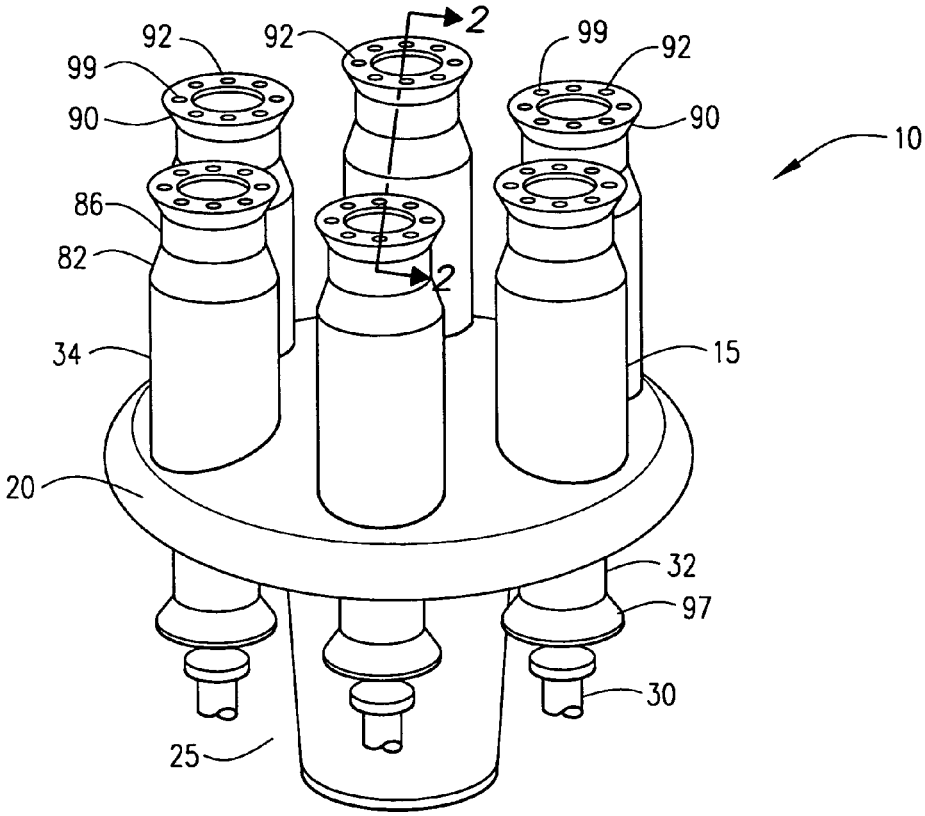
FIG. 1 is a perspective view of the flare apparatus of the current invention.

Referring now to the drawings, a flare apparatus, which may be referred to as a flare tip 10 is shown. Flare apparatus 10 is adapted to be used at the top of a flare stack, which as known in the art will communicate a combustible gas from a combustible gas source to flare apparatus 10. The combustible gas may be a waste gas from a refinery, processing plant, chemical plant, production site, LNG production plant, or other source. The gas may comprise, for example, propane, propylene, natural gas, hydrogen, carbon monoxide, ethylene or other gas. Flare apparatus 10 includes a plurality of flare tip units, or flare structures 15 for receiving the combustible gas from a single gas supply 20, which in FIG. 1 is a plenum 20. A gas pipe 25 connectable to the flare stack (not shown) will deliver combustible gas from the combustible gas source to the plenum 20.

Flare apparatus 10 may include a plurality of steam injectors 30 for providing a motive force to move air through each flare tip unit 15. Thus, each flare tip unit 15 may have a steam injector 30 associated therewith. Preferably, steam is provided to each steam injector 30 from a single steam source (not shown). The steam source may be connected to the steam injectors and controlled by any means known in the art. In operation, combustible gas is delivered into the plenum 20 through gas pipe 25. An air/steam and combustible gas mixture exits each of the flare tip units 15 and is ignited for efficient burning in the atmosphere. The flare apparatus 10 of the current invention is more efficient than prior art flare tips in that less steam is required. Apparatus 10 also operates with a lower noise level than other steam-assisted flare apparatus. These and other advantages will be explained in more detail hereinbelow.

Figure 2:
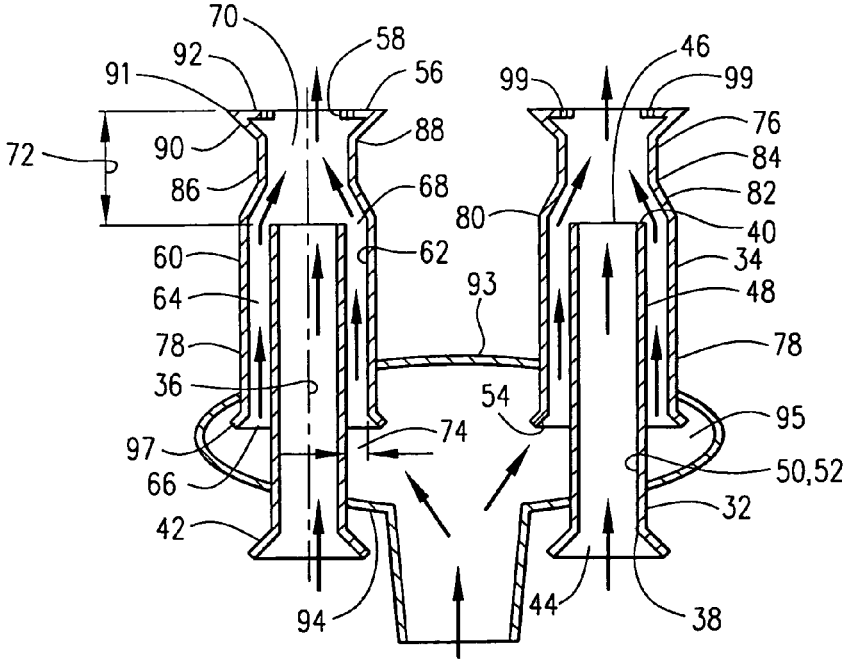
FIG. 2 is a section view is a section view taken from lines 2-2 of FIG. 1.

Referring now to FIG. 2, each flare tip unit 15 comprises an inner tubular member 32 and an outer tubular member 34. Inner member 32 is preferably a generally cylindrical inner member having a longitudinal central axis 36. Inner member 32 has first or lower end 38 and second or upper end 40. An inlet bell 42 may be defined at first end 38. The inlet bell will direct steam to the inlet 44. Steam injector 30 may be a spider-type injector, wherein the spider arms have holes through which the steam is injected. The steam may be directed into the surface of the inlet bell, and may be similar to an internal Coanda nozzle. Inner member inlet 44 is defined at lower end 38, while upper end 40 defines inner member outlet 46. In the preferred embodiment at least air, and preferably a steam/air mixture will pass through inner member 32 and through inner member outlet 46 into outer member 34. Inner member 32 has outer surface 48 and inner surface 50, which defines a passageway 52 for the air, or air/steam passing therethrough. Inner member 32 is preferably a straight cylinder from inlet 44 to outlet 46 with no bends, protrusions, depressions or other interruptions so that the flow of air or steam and air therethrough is uninterrupted.

Outer member 34 is preferably coaxial with inner member 32, and shares longitudinal central axis 36. Outer member 34 has first or lower end 54 and second or upper end 56. An exit opening 58 is defined at upper end 56. Outer member 34 has outer surface 60 and inner surface 62. An annular passageway which may be referred to as an annular gas passage 64 is defined by and between inner member 32 and outer member 34. A gas inlet 66 is defined in the embodiment shown at the lower end 54 of outer member 34 and a gas outlet 68 is defined at upper end 40 of inner member 32. As is apparent from the drawings, inner member outlet 46 is positioned lower than and is spaced from exit opening 58. The distance between outlet 46 and exit opening 58 may be referred to as a premix zone 70. Combustible gas exiting annular gas passage 64 through gas outlet 68 will enter the premix zone 70 and will mix with at least air, and in the embodiment shown an air and steam mixture passing through inner member outlet 46. The combustible gas will mix with the air/steam mixture in premix zone 70, and the gas/steam/air mixture will pass through exit opening 58 and will be ignited for burning in the atmosphere. Thus, the length of the premix zone is such that the air/steam flow in the internal cylinder will expand and mix with the combustible gas. A length 72 of premix zone 70 is preferably greater than a width 74 of annular gas passage 64 and is more preferably at least four times greater and more preferably four to five times greater than the width 74 of annular gas passage 64. The portion of outer member 34 that extends above inner member 32 to define premix zone 70 may also be referred to as a perimeter control portion since, in addition to allowing air and combustible gas to mix before combustion occurs, that portion of the outer member prevents ambient wind from sweeping away unburned combustible gas or causing smoke in the atmosphere.

In a preferred embodiment, outer member 34 comprises a cylindrical section 78 which extends from lower end 54 of the outer member to an upper end 80 of cylindrical section 78. Cylindrical section 78 may be referred to as a first cylindrical section 78. A radially inwardly directed cone, which may be referred to as a convergent cone 82, extends upwardly from upper end 80 and has an upper end 84. Convergent cone 82 will preferably promote mixing between gas and at least air. A second cylindrical section 86 extends upwardly from convergent cone 82. Second cylindrical section 86 will further promote mixing between gas and at least air and allows a more even velocity profile. Second cylindrical section 86 has an upper end 88. A radially outwardly directed cone which may be referred to as a divergent cone 90 extends upwardly from upper end 88. Preferably, divergent cone 90 diverges radially outwardly from second cylindrical section 86 at an angle of about 45° A flame retention ring 92 which is preferably a generally horizontal flame retention ring extends radially inwardly from upper end 91 of divergent cone 90. Flame retention ring 92 may have a plurality of openings 99 which will allow the combustible mixture to pass therethrough and form a stable flame on flame retention ring 92. FIG. 1 shows eight openings 97. However, there will preferably be more openings with closer spacing than the spacing shown in FIG. 1. Flame retention ring 92 preferably will not obstruct or limit flow of the air/steam and combustible gas mixture so that it will not cause combustible gas to flow backward or downwardly in the inner member in the case where the assisting media or motive gas (i.e., steam, compressed air, fuel gas or any other gas) or blower air is lost. The internal diameter of the flame retention ring 92, which comprises exit opening 58, is preferably equal to or only slightly smaller than the internal diameter of second cylindrical section 86. Preferably, the internal diameter of flame retention ring 92 is such that exit opening 58 has a cross-sectional area no less than the cross-sectional area of the annular gas outlet 68, and more preferably 20% more than the area of gas outlet 68.

In the embodiment of FIG. 2, plenum 20 comprises a generally curved upper plate 93 and a curved lower plate 94 which in cross section form a generally oval shape, and which define a plenum interior 95. Outer member 34 extends into plenum interior 95, so that lower end 54 and gas inlet 66 are disposed therein. Outer member 34 may have an inlet bell 97. Alternatively, outer member 34 may terminate in lower end 54 at curved upper plate 93, so that gas inlet 66 may be defined at the curved upper plate 93. Inner member 34 extends completely through plenum 20, so that the first and second ends 38 and 40, respectively, are positioned exterior to the plenum 20. Thus, a single combustible gas supply, namely plenum 20, provides combustible gas to a plurality of flare tip units 15 and more specifically communicates gas from a combustible gas source (not shown), which enters plenum 20 through gas pipe 25 to the annular gas passage 64 of each flare tip unit 15.

Combustible gas exits the annular gas passage 64 through gas outlet 68 and enters premix zone 70. The combustible gas mixes with at least air that is moved through inner member 32. Preferably, air is moved through each inner member 32 with steam that is injected into inner member 32 with a steam injector 30. As set forth herein, steam is preferably provided to each injector 30 from a single steam source, and is injected at a rate such that air will be drawn into inner member 32 along with the steam through inlet 44. Steam injector 30 may comprise a spider-type injector, or other known injector, or the steam injector and inlet bell 42 may act similar to an internal Coanda nozzle. An air/steam mixture will pass through inner member outlet 46 into premix zone 70 and mix with the combustible gas therein. The combustible air/steam mixture will pass through exit opening 58 where it will be ignited and burned in the atmosphere.

Figure 3:
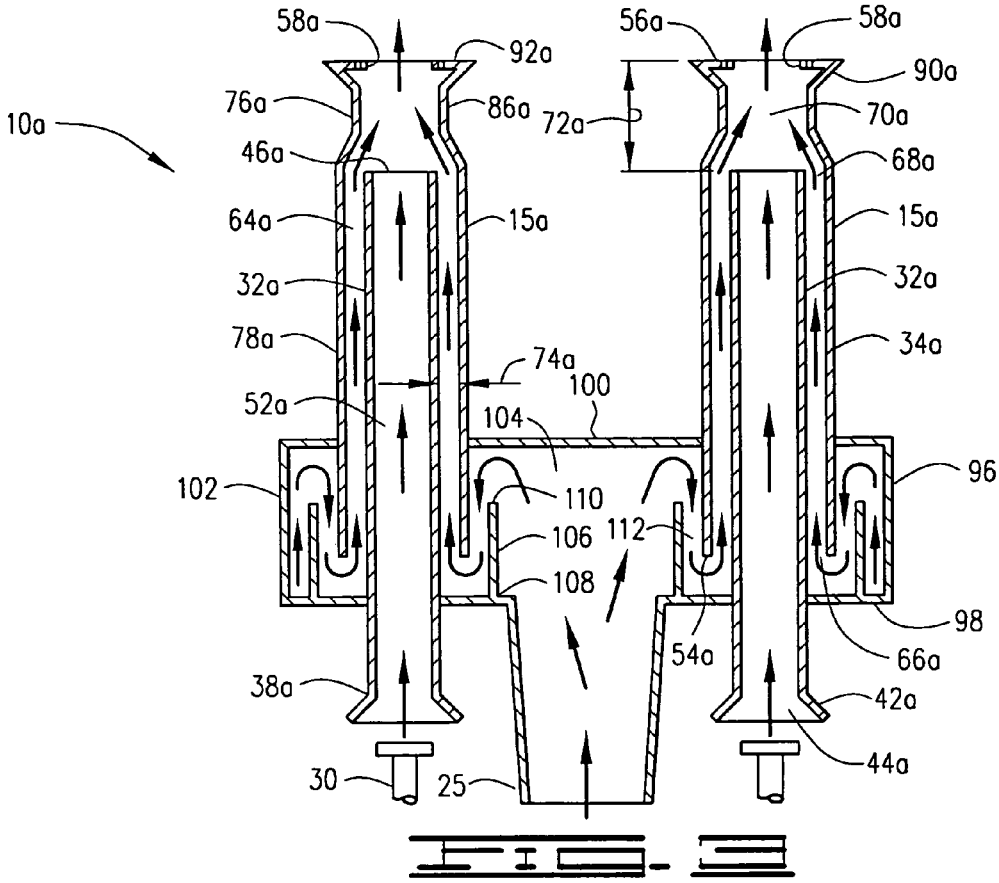
FIG. 3 is a section view similar to FIG. 2 of an additional embodiment of the current invention having a generally cylindrical shaped plenum.

Other plenum configurations may be used, and the description herein is not intended to be limiting. For example, the flare apparatus 10*a* shown in FIG. 3 has a plenum 96 that comprises a generally cylindrical drum with a lower plate 98, upper plate 100 and side wall 102 connecting the upper and lower plates 98 and 100. Like elements of the flare tip units are numbered similarly to the flare tip units in FIG. 2, but include the subscript "a." Plenum 96 defines a plenum interior 104 to which the combustible gas is provided as explained with respect to the embodiment shown in FIG. 2. In the embodiment shown in FIG. 3, a molecular seal, or tubular seal 106 is included. Molecular seal 106 has a lower end 108 connected to lower plate 98 and extending upwardly therefrom to an upper end 110. Upper end 110 is positioned at an elevation higher than lower end 54*a* of outer member 34*a* and circumscribes lower end 54*a*, so that a seal annulus 112 is defined between molecular seal 106 and outer member 34*a*. Thus, lower end 54*a* of outer member 34*a* is positioned with plenum interior 104 in the embodiment shown in FIG. 3. Combustible gas must pass into plenum 96 and around the upper end 110 of molecular seal 106, around lower end 54*a* of outer member 34*a* and upwardly into the annular gas passage 64*a*. Molecular seal 106 is optional but may be used to reduce the possibility of any internal burning or purge gas requirement. Molecular seal 106 will prevent air from moving into the plenum 96 and will prevent burning in the plenum. If air is heavier than the combustible gas the air will sit at the bottom of molecular seal 106. If air is lighter than the combustible gas, it will be pushed out by the combustible gas.

Figure 4:
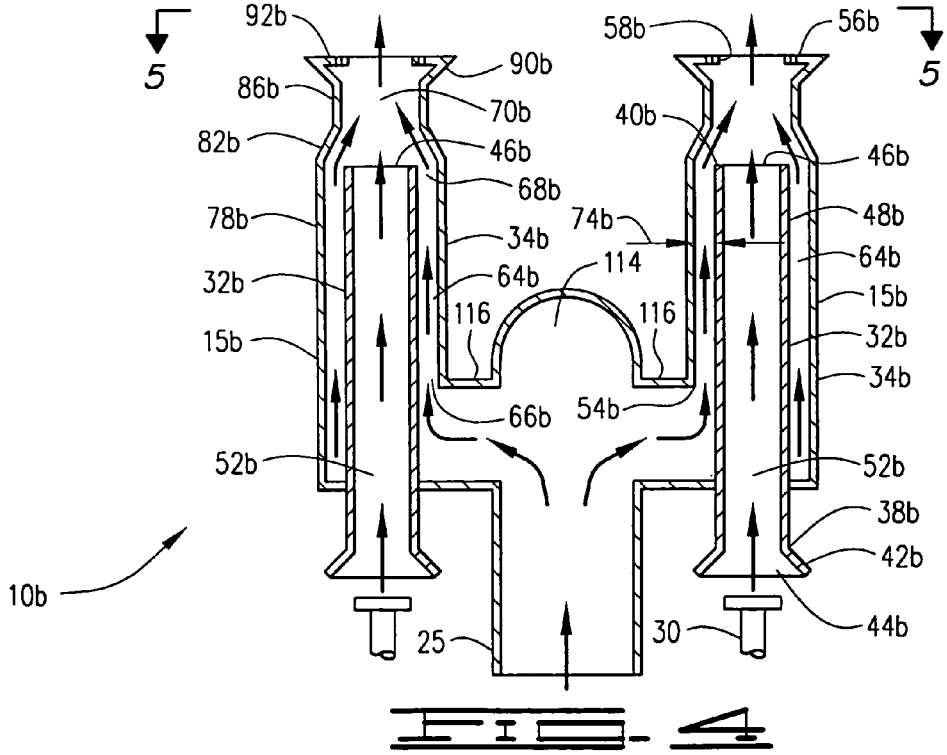
FIG. 4 is section view of an embodiment of the invention which utilizes a gas riser as a gas supply.
Figure 5:
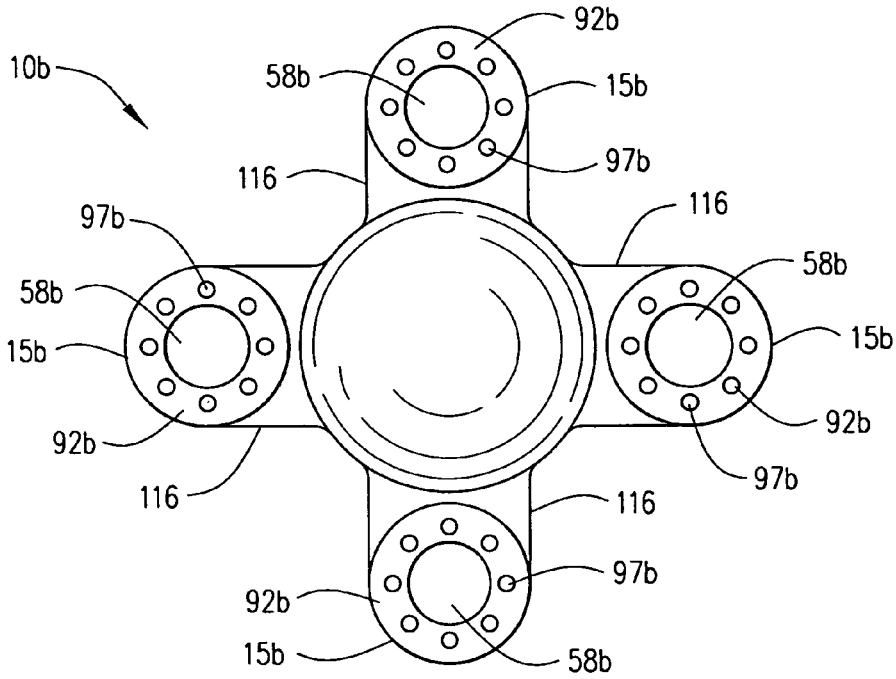
FIG. 5 is a view looking from line 5-5 of FIG. 4.

FIG. 4 shows a flare apparatus 10*b* of the current invention, where the gas supply comprises a riser 114 which receives gas from gas pipe 25. Gas riser 114 will distribute gas through tubular spokes 116 which will in turn each communicate combustible gas to flare tip units as described herein. Flare tip units in FIG. 4 are numbered similarly to FIG. 2, and include the subscript "b."

Figure 16:
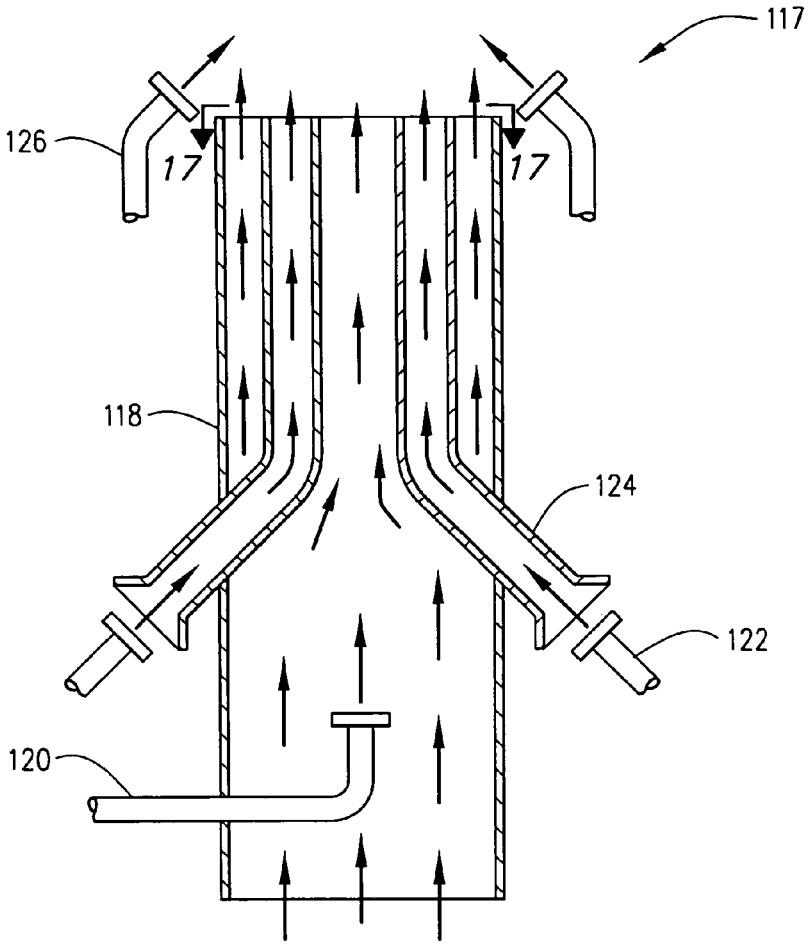
FIGS. 16 and 17 are schematic depictions of a prior art flare apparatus.
Figure 17:
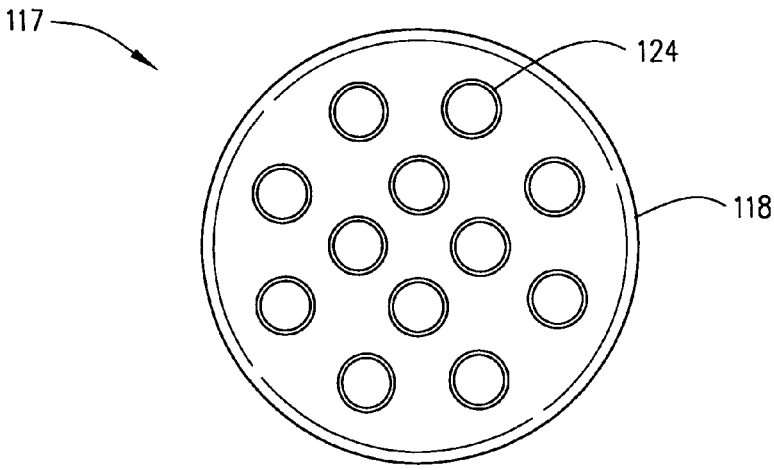

The flare apparatus of the current invention provides a number of advantages over the prior art flare apparatus, one configuration of which is schematically shown in FIGS. 16 and 17. Prior art flare tip 116 has an outer cylinder 118 into which combustible gas is communicated. Steam is injected into outer cylinder 118 through a center steam injector 120. A plurality of lower steam injectors 122 direct steam into a plurality of lower steam tubes 124. Combustible gas moves in outer cylinder 118 between lower steam tubes 124. Upper steam is injected through upper steam injectors 126. Upper steam is necessary to maintain perimeter control and to provide an efficient air/steam and combustible gas mixture above outer cylinder 118 for smokeless burning.

Flare tip 116 requires more steam than the flare apparatus of the current invention, since steam from the injectors 122 must make bends and turns rather than following the straight path defined by the inner members 32 of the current invention. In addition, because of the required center and upper steam and sometimes lower steam injectors, the noise generated by the prior art configuration is much greater and may require mufflers for the lower steam. The upper steam is difficult or impractical to muffle since flare flame can damage these mufflers. Each flare tip unit of the current invention requires only one injection location for steam and only requires one source of steam while separate sources of steam are typically required for the upper, lower and center steam injectors in the prior art configuration. Although sometimes the center, lower and upper steam can be connected to a common steam line, doing so reduces flexibility of operation and may create problems.

For example, connecting center steam to lower or upper steam renders it impossible to turn off center steam without turning off the other steam sources that share the common steam line. Under some adverse conditions, it is desirable to turn off the center steam and keep the other steam sources running. These adverse conditions include but are not limited to 1) freezing or arctic weather, 2) acid gas, 3) gas that reacts with water to form polymer. Under one or more of the above-mentioned adverse conditions, turning off the center steam typically requires a substantial increase in purge gas rate to prevent internal burning from damaging the flare tip rapidly. The increased purge gas rate often represents a high cost to the end user. The current invention does not require a center steam or a high purge rate to prevent internal burning. Testing has shown that when a minimal amount of motive force (e.g., steam or blower) is available, internal burning does not occur in the annular gas passage 64 or in the plenum 20, or in pipe 25. In the case of complete steam failure in the current invention, internal burning can be prevented, or at least limited by: 1) directing another motive gas such as compressed air or nitrogen to the steam line; 2) increasing the purge rate substantially, either of which may be automated.

Another disadvantage of the prior art configuration is the difficulty in coordinating the separate controls of lower and upper steam. Upper steam is typically injected vertically and inwardly. The upper steam from different steam nozzles may collide at the center above the flare tip, causing a local high pressure zone. This high pressure zone can drive a combustible mixture into the flare tip causing internal burning, and downward in the lower steam tubes which can cause the whole flare tip to be engulfed in flame. This is commonly referred to as the capping effect of upper steam. If the lower steam rate is insufficient to overcome the capping effect, the combustible mixture can travel downward and backward and exit at the inlet of the lower steam tubes, and the flare tip will be engulfed in flame causing rapid tip damage. Therefore, it is necessary to maintain sufficient lower-steam flow rate relative to the upper steam. The current invention requires only one single steam source, thus eliminating the need to coordinate the control of upper and lower steam.

Figure 15:
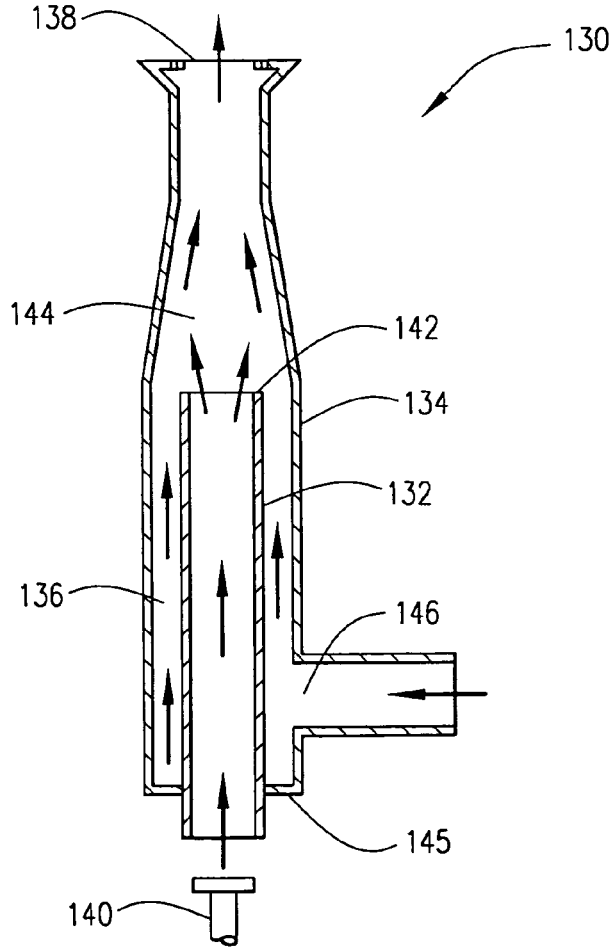
FIG. 15 shows an embodiment of a single flare tip unit.

The flare apparatus of FIGS. 1 and 2 comprises plenum 20 and six flare tip units 15. The riser embodiment of FIG. 4 has four flare tip units. More or less flare tip units may be used in the flare apparatus of the current invention, and if desired a single flare tip unit may be utilized as the flare apparatus. For example, FIG. 15 shows a single flare tip unit 130. Flare tip unit 130 is similar to each flare tip unit 15 and thus has an inner member 132 and outer member 134 defining an annular gas passage 136. Outer member 134 defines an exit opening 138. Inner member 132 is generally identical to the previously described inner member 32 and will preferably receive steam from a steam injector 140 or if desired can simply receive air from a fan or other known structure for moving air through inner member 132. It is understood that inner member 132 may optionally include an inlet bell. In the preferred embodiment, steam will be injected at a rate sufficient to entrain air and move air upwardly therethrough through an outlet 142 at the upper end of inner member 132 and into a premix zone 144. Outer member 134 has a closed lower end 145, and combustible gas inlet or entry 146 is defined through the side of outer member 134. Otherwise, outer member 134 is substantially identical to previously described outer member 34. Combustible gas will be provided from a flare stack as known in the art. The operation of a single flare tip unit 130 is as described with respect to flare tip units 15 in that the steam/air and combustible fuel mixture mixed in premix zone 144 exits through exit opening 138 and burns, preferably in a smokeless fashion, in the atmosphere.

Figure 8:
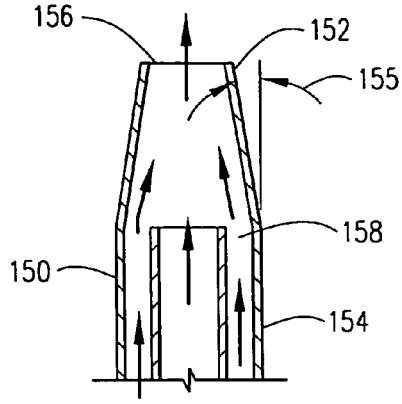
FIGS. 8-14 are alternative embodiments for flare tip units and specifically embodiments which have different outer member configurations.
Figure 9:
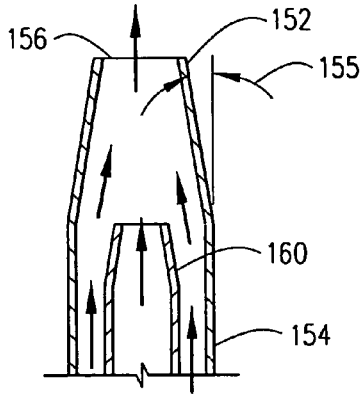
Figure 10:
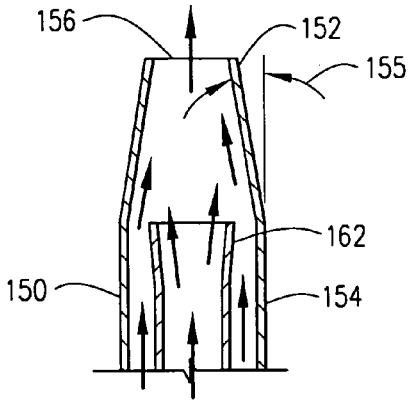

The outer member of the flare tip units of the flare apparatus described herein may comprise a number of different configurations. The upper portions of some exemplary configurations are shown in FIGS. 8-14. FIG. 8 shows an outer member 150 with a convergent cone 152 extending upwardly from the general cylindrical section 154 thereof. The cone angle 155 is between 0° and 75° and preferably roughly 17°. The exit opening 156 defined by convergent cone 152 preferably has an area not less than, and more preferably 20% more than the area of the choke point 158 of the annular fuel passage which is essentially the annular gas outlet. If desired, the upper end of the inner member of the flare tip unit can be fitted with a convergent cone 160 or divergent cone 162 as shown in FIGS. 9 and 10.

Figure 11:
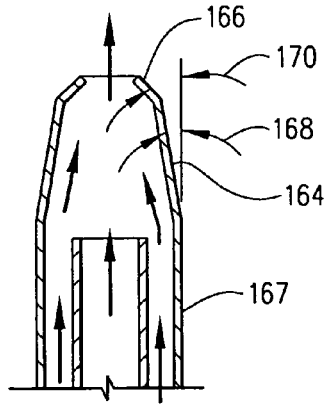
Figure 12:
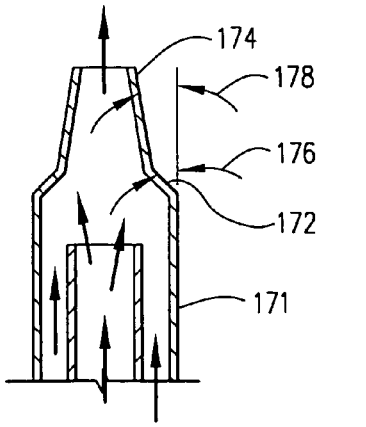
Figure 13:
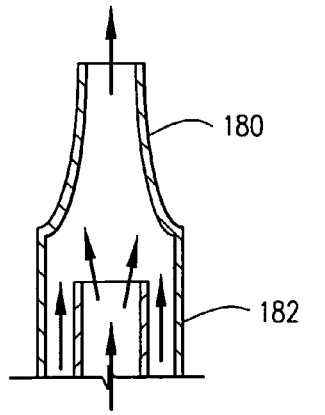
Figure 14:
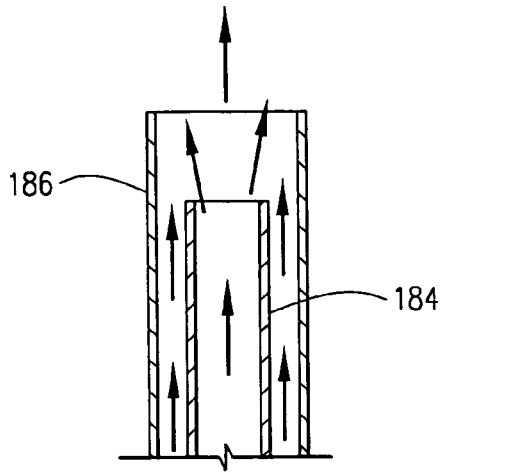

The outer member of the flare tip unit in FIG. 11 has first and second convergent cones 164 and 166 extending upwardly from the cylindrical portion 167 of the outer member of the flare tip unit wherein the cone angle 168 for first convergent cone 164 is less than the cone angle 170 for the second convergent cone 166. In FIG. 12, generally cylindrical portion 171 of the outer member may have first and second convergent cones 172 and 174, respectively, wherein first cone angle 176 is greater than second cone angle 178. A hyperbolic shape 180 extends upwardly from the cylindrical section 182 of the outer member of the flare tip unit shown in FIG. 13. The simplest configuration of a flare tip unit is shown in FIG. 14, which simply has straight cylindrical inner and outer members 184 and 186. It is understood that each of the flare tip units shown in FIGS. 8-14 will operate like the flare tip units 15 described herein. FIGS. 8-14 are added simply to exemplify the different configurations that are possible. The inner member in all cases is preferably a straight cylinder from the inlet to the outlet thereof with an optional inlet bell to direct steam.

Figure 6:
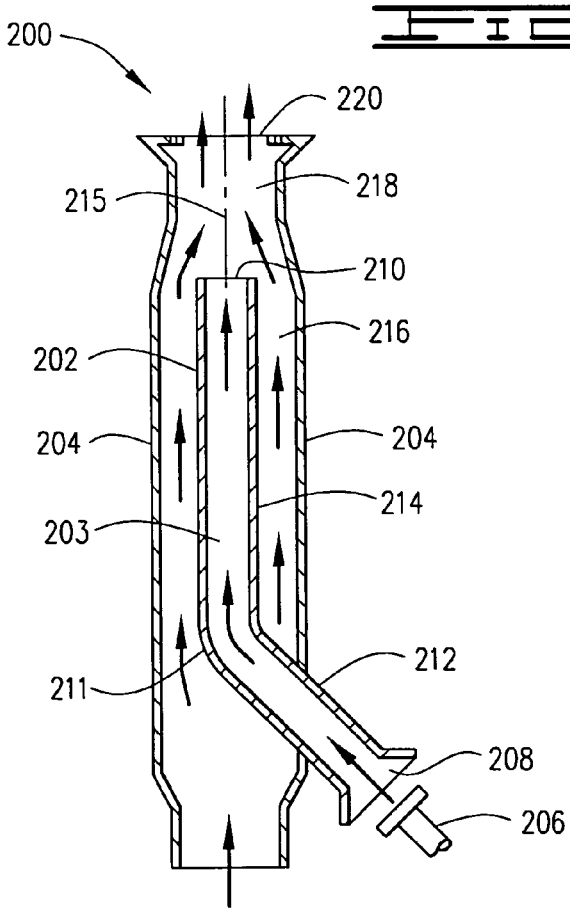
FIGS. 6 and 7 are alternative embodiments of flare tip units.
Figure 7:
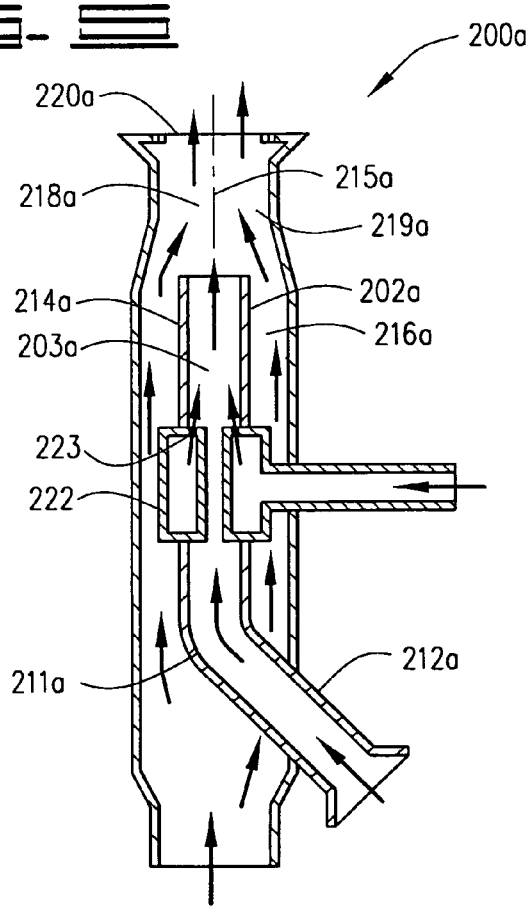

As discussed herein, the preferred embodiment of the flare tip units comprise flare tip unit 15, which has an outer member 34 and an inner member 32 wherein inner member 32 is substantially straight from the inlet 44 to the outlet 46 thereof. If desired, flare tip units may be utilized wherein the inner member has a bend therein as depicted in FIGS. 6 and 7. Therein, flare tip units 200 and **200*a*, respectively, are shown. Flare tip unit 200*a* is similar to flare tip 200 and so the same identifying numerals will be utilized for common parts with the subscript "a." Flare tip unit 200*a* adds an additional steam injection location, so the primary description will be with respect to flare tip unit 200**.

Flare tip unit 200 has an inner member 202 and outer member 204. Inner member 202 defines a passageway 203 and receives air, and preferably air moved by steam from a steam injector 206. Steam and air enter inlet 208 of inner member 202. Steam and air pass through an outlet 210 of the inner member 202. Inner member 202 passes through a side of outer member 204 and has a bend 211 therein from an inlet section 212 to a generally vertical section 214. Gas is communicated into outer member 204 and passes upwardly through an annular gas passage 216 defined between vertical portion 214 of inner member 202 and outer member 204. Vertical section 214 and outer member 204 are coaxial and share longitudinal central axis 215. A premix zone 218 is defined between outlet 210 and the exit opening 220 of outer member 214. Flare tip unit **200*a* is identical except that steam is injected into the inner member from a doughnut-shaped plenum 222 which has a plurality of openings 223 to communicate into the inner member 202**.

The flare apparatus, whether used as a single flare tip unit or as a plurality of flare tip units with a single combustible gas supply reduces the amount of steam necessary to achieve smokeless burning. For example, for a single flare tip unit comprising two straight cylinders like that shown in FIG. 14, a steam consumption rate of 3,200 pounds an hour achieved smokeless combustion of 13,000 pounds per hour of propylene. The inner member was an 8-inch diameter tubular member and the outer member was a 12-inch diameter tubular member. A similarly sized prior art apparatus similar to that shown in FIGS. 16 and 17, but which uses only center and upper steam injectors, requires 6,000 pounds per hour of steam to achieve smokeless burning of 16,000 pounds per hour of propylene. Thus, there is a 34% reduction of steam consumption. When the single unit as described herein is mathematically scaled up by a factor of two to a 16-inch diameter inner member and a 24-inch diameter external member, and the premix zone modified to that in FIG. 15. 13,000 pounds per hour of steam were required for 39,000 pounds per hour of smokeless combustion of propylene. For a similarly sized flare apparatus like that shown in FIGS. 16 and 17, 16,000 pounds per hour of steam are required to achieve 34,500 pounds per hour of propylene which is a 28% reduction of steam for propylene. When a plurality of flare tip units are connected by a plenum, the improved efficiencies are similar to those for single flare tip units, and in many cases may be higher because the space between the multiple flare tip units 15 allows air from the atmosphere to be entrained into the individual flames from each flare tip unit. Each individual flare tip unit has a flame thereabove and at some point all of the flames will merge to form a generally cylindrical flame with a hollow interior. Air may be entrained into the merged flames from the hollow interior. Ultimately as the height of the flame grows, a single flame may exist. Because of the additional air entrainment into the flame from the atmosphere, the current invention is more efficient in terms of smokeless performance than the prior art configuration which comprises a single flame as it exits the flare tip and will therefore entrain less air from the atmosphere than the current invention.

Thus it is seen that the present invention is well adapted to carry out the objects and attain the ends and advantages mentioned above as well as those inherent therein. While certain preferred embodiments of the invention have been described for the purpose of this disclosure, numerous changes in the construction and arrangement of parts and the performance of steps can be made by those skilled in the art, which changes are encompassed within the scope and spirit of this invention as defined by the appended claims.

What is claimed is:

1. A flare apparatus comprising:

a plurality of flare structures for burning a combustible gas, comprising:

an outer member having first and second ends, the second end defining an exit opening; and an inner member having an inlet and an outlet, at least a portion of the inner member being disposed in the outer member to define an annular gas passage therebetween, the inner member outlet being positioned below the exit opening of the outer member;

a plenum for receiving the combustible gas from a combustible gas source and communicating all of the combustible gas to the annular gas passages in the flare structures, the inner member extending from an exterior of the plenum through a plenum wall and into the outer member, the inner member having a substantially straight longitudinal central axis from the plenum wall through which it passes to the inner member outlet; and steam injectors for injecting steam into the inner member inlet of each inner member at a rate sufficient to draw air from the atmosphere outside the plenum into the inner member, and move the air through the inner member wherein an air/steam mixture exits the inner member outlet into the outer member and the air/steam mixture mixes with the combustible gas from the annular gas passage in the outer member above the inner member outlet, and the combustible gas and air/steam mixture exits the outer member through the exit opening for burning, wherein the exit openings of each flare structure are spaced apart such that each flare structure has an individual flame thereabove, and wherein air is entrained into each individual flame.

2. The flare apparatus of claim 1, wherein the first end of the outer member of each of the flare structures defines a gas inlet for communicating the combustible gas into the annular gas passage.

3. The flare apparatus of claim 1, wherein the outer member of each of the flare structures comprises a straight cylinder from the gas inlet to a gas outlet through which gas passes out of the annular gas passage.

4. The flare apparatus of claim 1, the outer member of each flare structure comprising:

a cylindrical portion having an upper end; and a convergent cone extending upwardly from the upper end of the cylindrical portion, wherein the convergent cone directs combustible gas from the annular gas passage radially inwardly toward the air/steam mixture exiting the inner member outlet.

5. The flare apparatus of claim 4, wherein at least a portion of the convergent cone extends above the outlet of the inner member.

6. The flare apparatus of claim 5, the outer member further comprising a second cylindrical portion extending upwardly from the convergent cone.

7. The flare apparatus of claim 6, the outer member further comprising a divergent cone extending upwardly from the second cylindrical portion, and a generally horizontal ring extending radially inwardly from an upper end of the divergent cone, wherein the horizontal ring defines the exit opening.

8. The flare structure of claim 1, wherein the inner member of each flare structure is a substantially straight cylinder from the inner member inlet, positioned exterior to the plenum, to the inner member outlet.

9. The flare apparatus of claim 1, wherein the flames from each flare structure merge into a flame with a hollow interior.

10. A flare apparatus for burning a combustible gas comprising:

a plurality of flare tip units, the flare tip units being spaced such that each flare tip unit has an individual flame thereabove spaced from the individual flames above the other of the flare tip units, each flare tip unit comprising:

a single outer member having first and second ends, a portion of the single outer member defining a convergent cone; and a single inner member having an inlet and an outlet, wherein at least a portion of the inner member is disposed in the outer member to define an annular gas passage and wherein at least a portion of the convergent cone extends above the inner member outlet; and a plenum connectable to a source of combustible gas for communicating the combustible gas to the annular gas passage of each of the flare tip units, wherein all of the combustible gas received by the plenum is communicated to the annular gas passages of the flare tip units and each annular gas passage receives a portion of the combustible gas, the combustible gas exiting the annular gas passage in each flare tip unit being directed radially inwardly by the convergent cone to mix in the outer member with at least air passing through the outlet of each inner member, and wherein the at least air and combustible gas mixture passes through an exit opening defined at the second end of the outer member and is burned to create the individual flame thereabove.

11. The flare apparatus of claim 10, the first end of each outer member defining the gas inlet for the annular gas passage.

12. The flare apparatus of claim 10, the plenum defining a plenum interior, combustible gas being communicated into the plenum interior from the combustible gas source, wherein the first end of each outer member is located within the plenum interior and extends from the plenum interior to a plenum exterior, and wherein the inner member passes completely through the plenum, so that the inner member inlet and outlet of each flare tip unit are outside the plenum.

13. The flare apparatus of claim 12, the plenum comprising:

a generally flat upper plate;

a cylindrical side wall connected to and extending downwardly from the upper plate; and a flat lower plate connected to the cylindrical side wall, the lower plate having an opening for receiving the combustible gas, wherein the upper and lower plates and the side wall define the plenum interior.

14. The flare apparatus of claim 10, the plenum comprising a curved upper plate connected to a curved lower plate to define the plenum interior.

15. The flare apparatus of claim 14, wherein the curved upper and lower plates are connected by a side wall.

16. The flare apparatus of claim 10 further comprising steam injectors for injecting steam into each inner member wherein the steam draws air into the inner member so that an air/steam mixture passes through the inner member outlet and mixes in the outer member with the combustible gas, and wherein a steam/air and combustible gas mixture passes through the exit opening of each flare tip unit and is ignited to create the individual flame above each flare tip unit.

17. The flare apparatus of claim 16, wherein the portion of the inner member disposed in the outer member is a substantially straight cylinder.

18. The flare apparatus of claim 17, wherein the inner member inlet is exposed to air outside the inner and outer members so that outside air is drawn into the inner member.

19. The flare apparatus of claim 17, the portion of the inner member passing through the plenum comprising a straight cylinder.

20. The flare apparatus of claim 19, the inner member comprising a straight cylinder from the inner member inlet to the inner member outlet.

21. The flare apparatus of claim 16, wherein each individual flame is separated from other individual flames so that air is entrained into each individual flame.

22. The flare apparatus of claim 21, wherein the individual flames merge to form a single flame with a hollow interior.

23. The flare apparatus of claim 10, wherein each outer member comprises:

a first cylindrical portion, the convergent cone extending upwardly from the first cylindrical portion.

24. The flare apparatus of claim 23, each outer member further comprising:

a second cylindrical portion extending upwardly from the convergent cone;

a divergent cone extending upwardly from the second cylindrical section; and a flame retention ring extending inwardly from the divergent cone and defining the exit opening.

25. The flare apparatus of claim 10, further comprising a steam injector associated with each inner member for injecting steam into the inner members of each flare tip unit at a rate sufficient to draw air into the inner member and move air therethrough.

26. The flare apparatus of claim 25, each flare tip unit defining a premix zone between the inner member outlet and the exit opening in which a steam/air mixture exiting the inner member outlet mixes with combustible gas exiting the annular gas passage prior to the gas/steam/air mixture passing through the exit opening.

27. The flare apparatus of claim 26 wherein a portion of the outer member extending above the inner member of each flare tip unit comprises a perimeter control portion.

28. The flare apparatus of claim 25, wherein the steam injectors receive steam from a single steam source.

29. A flare apparatus comprising:

a plurality of steam-assisted flare structures for burning a combustible gas, each flare structure comprising:

a single outer member comprising a cylindrical section and a convergent cone extending upwardly from the cylindrical section, the single outer member having a first end and a second end, the second end defining an exit opening;

a single inner member having an inner member inlet and an inner member outlet, at least a portion of the single inner member being coaxially disposed in the outer member and defining a passage therethrough for air and steam, the inner member having a straight longitudinal central axis from the inner member inlet to the inner member outlet;

an annular gas passage defined by and between the outer member and the inner member; and a steam injector for injecting steam into the single inner tubular member at a rate sufficient to pull air from outside the inner and outer members into the inner member, wherein steam and air pass through the inner member outlet into a premix zone in the outer member and wherein gas communicated into the annular gas passage exits the annular gas passage into the premix zone, and wherein the convergent cone defines at least a portion of the premix zone and directs gas from the annular gas passage radially inwardly in the premix zone where gas mixes with the steam and air therein, so that a combustible gas, steam and air mixture exits through the exit opening; and a plenum, wherein the plenum receives the combustible gas from a combustible gas source and communicates all of the combustible gas into the annular gas passages of the plurality of flare structures, the inner member inlet of the flare structures being positioned exterior to the plenum.

30. The flare apparatus of claim 29 wherein a single steam source provides steam to each of the plurality of steam injectors in the plurality of flare structures.

31. The flare apparatus of claim 30, wherein the distance from the inner member outlet to the exit opening is greater than a width of the annular gas passage.

32. The flare apparatus of claim 31, wherein the distance from the inner member outlet to the exit opening is at least four times the width of the annular gas passage.

33. The flare apparatus of claim 29, wherein the first end of each outer member defines a gas inlet to the annular gas passage in each of the plurality of flare structures.

34. The flare apparatus of claim 29 wherein the portion of the inner member disposed in the outer member is a straight cylinder.

35. The flare apparatus of claim 34, the inner member comprising a straight cylinder from the exterior of the plenum to the inner member outlet.

36. The flare apparatus of claim 29 further comprising:

a second cylindrical section extending upwardly from the convergent cone;

a divergent cone extending upwardly from the second cylindrical section; and a flame retention ring connected to an upper end of the divergent cone.

37. The flare apparatus of claim 29 wherein flames from each of the flare structures merge into a flame with a hollow interior.

38. A method of burning a combustible gas comprising:

(a) providing combustible gas to a plenum, the plenum having a plurality of flare tip units connected thereto, each flare tip unit comprising coaxial inner and outer tubular members defining an annular gas passage therebetween;

(b) communicating all of the combustible gas from the plenum into the annular gas passages of each flare tip unit;

(c) moving air into an inner member inlet and through an inner member outlet into a premix zone in the outer member of each flare tip unit, the inner member having a straight longitudinal central axis from the inner member inlet to the inner member outlet;

(d) passing the combustible gas through the annular gas passage of each flare tip unit into the premix zone;

(e) directing the combustible gas radially inwardly toward the air moving through the outlet of the inner member;

(f) discharging the air and combustible gas through an exit opening of each outer member;

(g) spacing the flare tip units so that a flame created by igniting the combustible mixture from each flare tip unit is spaced from the flames of the other flare tip units; and (h) igniting the air and combustible gas.

39. The method of claim 38, the moving step comprising injecting steam into the inner member at a rate sufficient to entrain and move air into the inner member and through the inner member outlet.

40. The method of claim 39 comprising mixing a steam/air mixture from the inner member with the combustible gas in the premix zone to form a combustible mixture of steam, air and gas, and igniting the combustible mixture that passes through the exit opening.

41. The method of claim 38 comprising injecting steam into the inner member of each flare tip unit from a single steam source.

42. The method of claim 38, wherein a length of the premix zone is at least four times a width of the annular gas passage.

43. The method of claim 38, further comprising merging each flame into a single flame with a hollow interior.

* * * * *

UNITED STATES PATENT AND TRADEMARK OFFICE

CERTIFICATE OF CORRECTION

PATENT NO. : 7,967,600 B2
APPLICATION NO. : 11/390953
DATED : June 28, 2011
INVENTOR(S) : Jianhui Hong et al.

It is certified that error appears in the above-identified patent and that said Letters Patent is hereby corrected as shown below:

Title page, Item (56) For. Pat. Docs., Line 1, delete "8/1992" and insert --8/1982-- therefor;

Column 2, line 53, delete "in to" and insert --into-- therefor;

Column 2, line 66, delete "is a section view," second occurrence.

Column 8, line 53, after "15," delete the "." and insert a --,-- therefor.

Signed and Sealed this
Eighteenth Day of October, 2011

David J. Kappos

David J. Kappos
*Director of the United States Patent and Trademark Office*